US009671741B2

(12) United States Patent
Matsuo et al.

(10) Patent No.: US 9,671,741 B2
(45) Date of Patent: Jun. 6, 2017

(54) IMAGE FORMING APPARATUS

(71) Applicant: Konica Minolta, Inc., Chiyoda-ku, Tokyo (JP)

(72) Inventors: Masahiro Matsuo, Tokyo (JP); Takahiro Okubo, Kanagawa (JP); Akihiko Kakita, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 14/671,044

(22) Filed: Mar. 27, 2015

(65) Prior Publication Data

US 2015/0277334 A1 Oct. 1, 2015

(30) Foreign Application Priority Data

Mar. 31, 2014 (JP) ..... 2014-073578

(51) Int. Cl.
*G03G 15/00* (2006.01)
*B65H 7/06* (2006.01)
(Continued)

(52) U.S. Cl.
CPC ..... *G03G 15/70* (2013.01); *B65H 5/26* (2013.01); *B65H 7/06* (2013.01); *B65H 7/20* (2013.01); *G03G 15/5012* (2013.01)

(58) Field of Classification Search
CPC ..... G03G 2215/00544; B65H 7/06
(Continued)

(56) References Cited

U.S. PATENT DOCUMENTS 4,908,655 A * 3/1990 Takagi ..... G03G 15/55 340/675
5,019,856 A * 5/1991 Ohashi ..... G03B 27/32 355/402
(Continued)

FOREIGN PATENT DOCUMENTS

EP 2169469 A1 * 3/2010
JP 04148754 A 5/1992
(Continued)

OTHER PUBLICATIONS

Japanese Notice of the Reasons for Rejection corresponding to Application No. 2014-073578; Dated: Mar. 22, 2016, with English translation.
(Continued)

*Primary Examiner* — Anthony Nguyen
(74) *Attorney, Agent, or Firm* — Cantor Colburn LLP

(57) ABSTRACT

An image forming apparatus includes: an image forming section that electrophotographically forms an image on a sheet; and a sheet feeding path including a first sheet feeding path that conveys a sheet to the image forming section, and a second sheet feeding path provided continuously with the first sheet feeding path. Unjamming is allowed to be performed by separating the apparatus at a boundary between the first sheet feeding path and the second sheet feeding path, and by pulling out the first sheet feeding path. The apparatus further includes: a jam detection section that detects an occurrence of a jam in the sheet feeding path; and a jam clearing section that determines a procedure for unjamming in accordance with a state of a sheet on the sheet feeding path when a jam occurs, and the jam clearing section makes a request to perform unjamming according to a determined procedure.

9 Claims, 8 Drawing Sheets

(51) Int. Cl.
*B65H 7/20* (2006.01)
*B65H 5/26* (2006.01)

(58) Field of Classification Search
USPC ..... 400/621; 399/21
See application file for complete search history.

(56) References Cited

U.S. PATENT DOCUMENTS

| | | | | |
|---|---|---|---|---|
| 5,532,793 | A * | 7/1996 | Kogure | G03G 15/234 271/184 |
| 5,678,138 | A * | 10/1997 | Kobayashi | G03G 15/0131 271/258.02 |
| 5,692,230 | A * | 11/1997 | Yoshiuchi et al. | 399/21 |
| 6,876,820 | B2 * | 4/2005 | Hirai et al. | 399/21 |
| 7,018,120 | B2 * | 3/2006 | Takagi | B41J 13/009 399/20 |
| 9,323,202 | B2 * | 4/2016 | Akimoto | G03G 15/70 |
| 2003/0156298 | A1 * | 8/2003 | Matsuyama et al. | 358/1.1 |
| 2011/0123245 | A1 * | 5/2011 | Gocho | 400/621 |

FOREIGN PATENT DOCUMENTS

| | | | |
|---|---|---|---|
| JP | 10020593 | A | 1/1998 |
| JP | 2004262665 | A | 9/2004 |
| JP | 2005335886 | A | 12/2005 |
| JP | 2010085659 | A | 4/2010 |

OTHER PUBLICATIONS

Japanese Notice of the Reasons for Rejection corresponding to Application No. 2014-073578; Dated: Jul. 26, 2016, with English translation.

* cited by examiner

UNJAMMING PROCEDURE 1-1

PROCEDURE 1: PULL OUT SHEET FROM SHEET FEEDING SIDE
PROCEDURE 2: TURN SHEET FEEDING SIDE UNJAMMING NOB TWO TURNS
PROCEDURE 3: PULL OUT SHEET CONVEYANCE UNIT AND REMOVE SHEET INSIDE

FIG. 6A

UNJAMMING PROCEDURE 1-2

PROCEDURE 1: PULL OUT SHEET FROM SHEET FEEDING SIDE AND SHEET EJECTION SIDE
PROCEDURE 2: TURN SHEET FEEDING SIDE UNJAMMING NOB TWO TURNS
PROCEDURE 3: TURN SHEET EJECTION SIDE UNJAMMING NOB TWO TURNS
PROCEDURE 4: PULL OUT SHEET CONVEYANCE UNIT AND REMOVE SHEET INSIDE

FIG. 6B

UNJAMMING PROCEDURE 1-3

PROCEDURE 1: PULL OUT SHEET FROM SHEET EJECTION SIDE
PROCEDURE 2: TURN SHEET EJECTION SIDE UNJAMMING NOB TWO TURNS
PROCEDURE 3: PULL OUT SHEET CONVEYANCE UNIT AND REMOVE SHEET INSIDE

FIG. 6C

UNJAMMING PROCEDURE 2-1

PROCEDURE 1: PULL OUT SHEET FROM SHEET FEEDING SIDE

FIG. 7A

UNJAMMING PROCEDURE 2-2

PROCEDURE 1: PULL OUT SHEET FROM SHEET EJECTION SIDE

FIG. 7B

UNJAMMING PROCEDURE 1-1

PROCEDURE 1: CUT SHEET AT SHEET FEEDING SIDE BOUNDARY
PROCEDURE 2: PULL OUT SHEET FROM SHEET FEEDING SIDE
PROCEDURE 3: TURN SHEET FEEDING SIDE UNJAMMING NOB TWO TURNS
PROCEDURE 4: PULL OUT SHEET CONVEYANCE UNIT AND REMOVE SHEET INSIDE

FIG. 8A

UNJAMMING PROCEDURE 1-2

PROCEDURE 1: CUT SHEET AT SHEET FEEDING SIDE BOUNDARY AND SHEET EJECTION SIDE BOUNDARY
PROCEDURE 2: PULL OUT SHEET FROM SHEET FEEDING SIDE AND SHEET EJECTION SIDE
PROCEDURE 3: TURN SHEET FEEDING SIDE UNJAMMING NOB TWO TURNS
PROCEDURE 4: TURN SHEET EJECTION SIDE UNJAMMING NOB TWO TURNS
PROCEDURE 5: PULL OUT SHEET CONVEYANCE UNIT AND REMOVE SHEET INSIDE

FIG. 8B

UNJAMMING PROCEDURE 1-3

PROCEDURE 1: CUT SHEET AT SHEET EJECTION SIDE BOUNDARY
PROCEDURE 2: PULL OUT SHEET FROM SHEET EJECTION SIDE
PROCEDURE 3: TURN SHEET EJECTION SIDE UNJAMMING NOB TWO TURNS
PROCEDURE 4: PULL OUT SHEET CONVEYANCE UNIT AND REMOVE SHEET INSIDE

FIG. 8C

IMAGE FORMING APPARATUS

CROSS REFERENCE TO RELATED APPLICATIONS

This application is entitled to and claims the benefit of Japanese Patent Application No. 2014-073578, filed on Mar. 31, 2014, the disclosure of which including the specification, drawings and abstract is incorporated herein by reference in its entirety.

BACKGROUND OF THE INVENTION

Field of the Invention

The present invention relates to an electrophotographic image forming apparatus.

Description of Related Art

In general, an electrophotographic image forming apparatus (such as a printer, a copy machine, and a fax machine) is configured to irradiate (expose) a uniformly-charged photoconductor (for example, a photoconductor drum) with (to) laser light based on image data to form an electrostatic latent image on the surface of the photoconductor. The electrostatic latent image is then visualized by supplying toner from a developing device to the photoconductor on which the electrostatic latent image is formed, whereby a toner image is formed. Further, the toner image is directly or indirectly transferred to a sheet through an intermediate transfer belt, followed by heating and pressurization for fixing, whereby an image is formed on the sheet.

The above-described image forming apparatus includes a sheet conveyance section that conveys to an image forming section a sheet fed from a sheet feeding section (which includes sheet feed tray, manual sheet feeding section, an external sheet feeding device, and the like). The sheet conveyance section includes a plurality of conveyance roller sections, and at least one of the conveyance roller sections sandwiches a sheet when conveying the sheet. The sheet feeding path of the image forming apparatus includes a sheet feeding path on the sheet feeding side (hereinafter referred to as "sheet feeding path"), a sheet feeding path of the sheet conveyance section (hereinafter referred to as "conveyance path"), and a sheet feeding path on the ejection side (hereinafter referred to as "sheet ejection path").

Typically, when a jam has occurred in a sheet feeding path, the user pinches the leading end portion of the sheet remaining in the sheet feeding path and pulls out the sheet to the sheet ejection side, or the user pinches the rear end portion of the sheet and pulls out the sheet to the sheet feeding side, to remove the sheet. In addition, a technique has been proposed in which a sheet is cut such that the sheet is divided into a part on which a toner image is transferred and a part on which no toner image is transferred, and the former part is removed from the sheet ejection side whereas the latter part is removed from the sheet feeding side, thereby preventing unfixed toner from being attached on a registration roller and the like on the sheet feeding side (for example, PTL 1: Japanese Patent Application Laid-Open No. 10-20593).

In recent years, an image forming apparatus has been practically used in which a sheet conveyance section configured to invert a sheet for both-side printing is mounted as a sheet conveyance unit (so-called Auto-Duplex Unit (ADU)). In such an image forming apparatus, the conveyance path in the sheet conveyance unit is detachable from the image forming apparatus, but a sheet feeding path and a sheet ejection path are fixed to the image forming apparatus main body.

When a jam has occurred in such an image forming apparatus, the sheet conveyance unit is pulled out from the image forming apparatus main body to perform unjamming. Various members (for example, a guide member) provided to the sheet feeding path can be exposed by pulling out the sheet conveyance unit from the image forming apparatus, and thus a sheet can be carefully removed from an suitable place so as not to scatter unfixed toner.

On the other hand, depending on the location of a jam, the length of the sheet feeding path, and the sheet length, the sheet may protrude from the sheet conveyance unit into the sheet feeding path or the sheet ejection path. When the sheet conveyance unit is pulled out of the image forming apparatus main body in this state, the sheet tears and breaking occurs. For this reason, the sheet conveyance unit is pulled out after the sheet is sent into the sheet conveyance unit by a conveyance roller section.

When a jam has occurred during image formation using flat sheets, breaking can be prevented by the above-described way. However, when a jam has occurred during image formation using a long sheet, the long sheet cannot be sent into the sheet conveyance unit, and the breaking cannot be easily prevented in many cases. If a space for sending the entirety of a long sheet is ensured in the sheet conveyance unit, the size of the apparatus may possibly be increased.

In addition, unjamming may be performed by pulling out the long sheet to the sheet feeding side or the sheet ejection side after the long sheet is cut in the image forming apparatus in which the technology disclosed in PTL 1 is applied. In this case, however, since an unfixed toner image is formed on the part pulled out from the sheet ejection side, scattering of toner or the like may possibly occur at the time when the sheet is pulled out.

SUMMARY OF THE INVENTION

An object of the present invention is to provide an image forming apparatus which can prevent breaking from occurring at the time when a sheet conveyance unit is pulled out to perform unjamming, and can facilitate an unjamming work.

To achieve the abovementioned object, an image forming apparatus reflecting one aspect of the present invention includes: an image forming section configured to form an image on a sheet; a sheet feeding path including a first sheet feeding path configured to convey a sheet to the image forming section, and a second sheet feeding path provided continuously with the first sheet feeding path; a jam detection section configured to detect an occurrence of a jam in the sheet feeding path; and a jam clearing section configured to determine a procedure for unjamming in accordance with a state of a sheet on the sheet feeding path when a jam occurs, and to make a request to perform unjamming according to a determined procedure, wherein the image forming apparatus is an electrophotographic image forming apparatus in which unjamming is allowed to be performed by separating the image forming apparatus at a boundary between the first sheet feeding path and the second sheet feeding path, and by pulling out the first sheet feeding path.

BRIEF DESCRIPTION OF DRAWINGS

The present invention will become more fully understood from the detailed description given hereinbelow and the appended drawings which are given by way of illustration only, and thus are not intended as a definition of the limits of the present invention, and wherein:

FIG. 6A illustrates an example of unjamming procedure 1-1;

FIG. 6B illustrates an example of unjamming procedure 1-2;

FIG. 6C illustrates an example of unjamming procedure 1-3;

FIG. 7A illustrates an example of unjamming procedure 2-1;

FIG. 7B illustrates an example of unjamming procedure 2-2;

FIG. 8A illustrates another example of unjamming procedure 1-1;

FIG. 8B illustrates another example of unjamming procedure 1-2; and

FIG. 8C illustrates another example of unjamming procedure 1-3.

DESCRIPTION OF THE PREFERRED EMBODIMENTS

Figure 1:
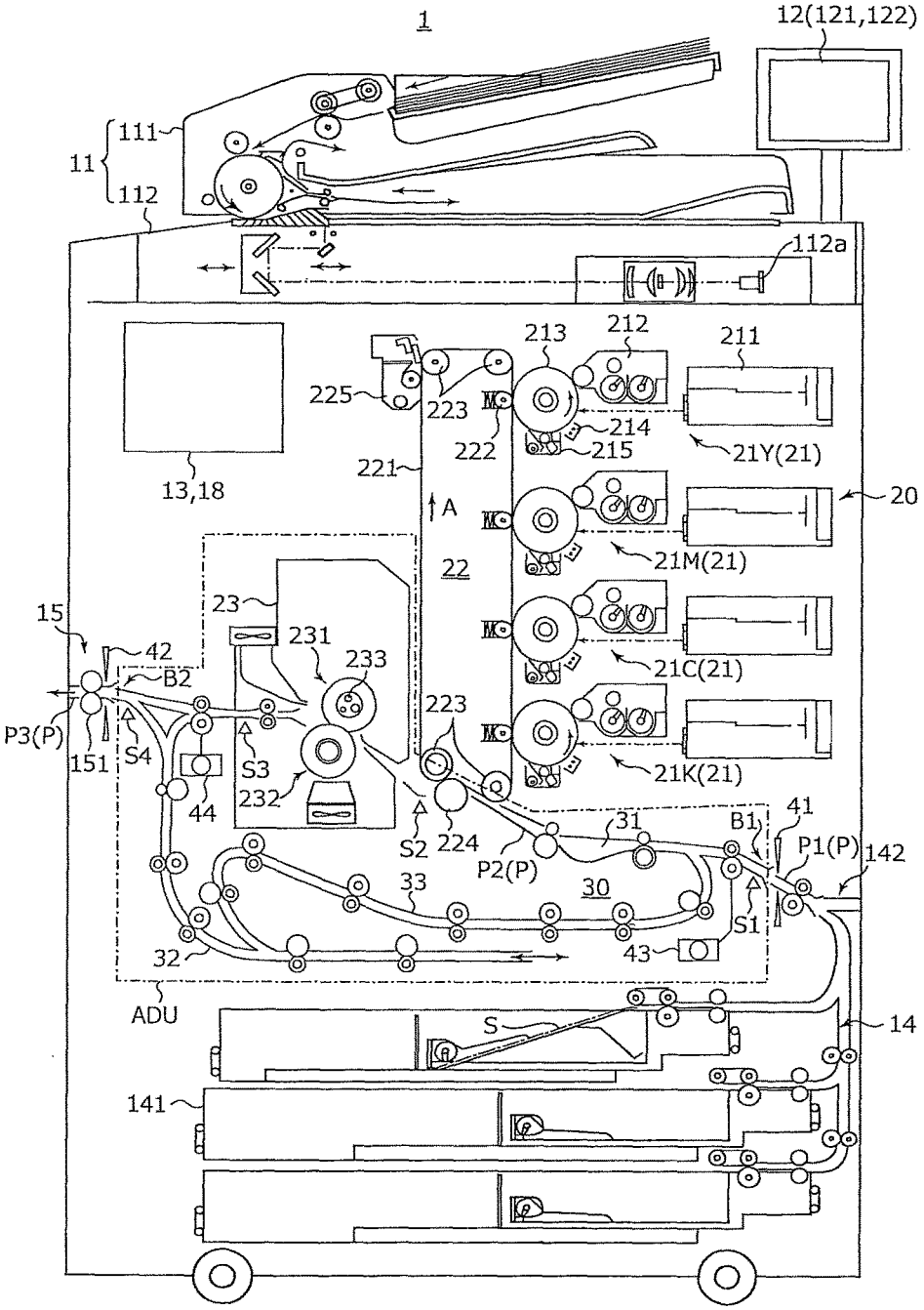
FIG. 1 illustrates a general configuration of an image forming apparatus according to an embodiment of the present invention.
Figure 2:
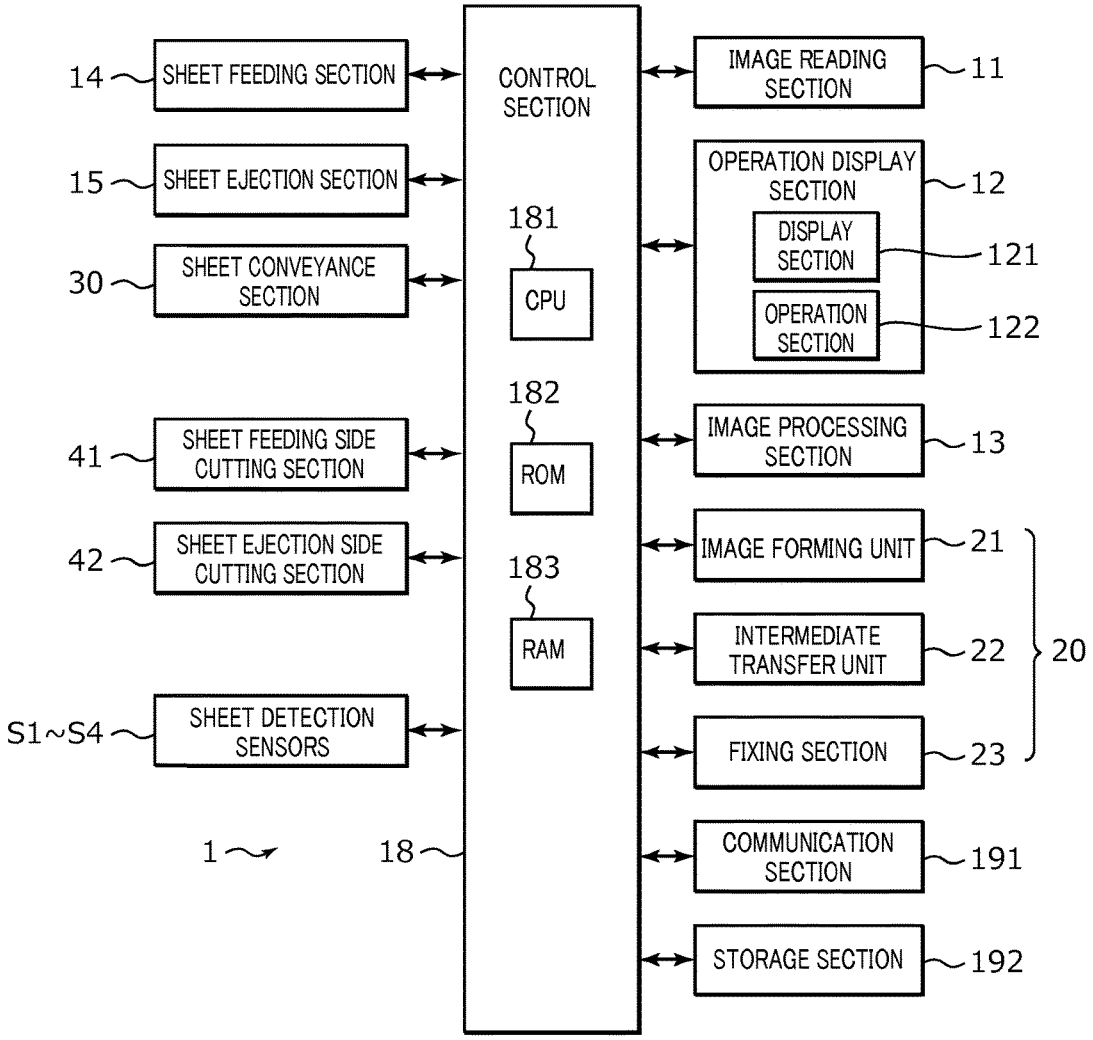
FIG. 2 illustrates a principal part of a control system of an image forming apparatus.

FIG. 1 illustrates a configuration of image forming apparatus 1 according to the embodiment of the present invention. FIG. 2 illustrates a principal part of a control system of image forming apparatus 1.

Image forming apparatus 1 illustrated in FIGS. 1 and 2 is a color image forming apparatus of an intermediate transfer system using electrophotographic process technology. A longitudinal tandem system is adopted for image forming apparatus 1. In the longitudinal tandem system, respective photoconductor drums 213 corresponding to the four colors of YMCK are placed in series in the travelling direction (vertical direction) of intermediate transfer belt 221, and the toner images of the four colors are sequentially transferred to intermediate transfer belt 221 in one cycle.

That is, image forming apparatus 1 transfers (primary-transfers) toner images of yellow (Y), magenta (M), cyan (C), and black (K) formed on photoconductor drums 213 to intermediate transfer belt 221, and superimposes the toner images of the four colors on one another on intermediate transfer belt 221. Then, image forming apparatus 1 secondary-transfers the resultant image to a sheet, thereby forming an image.

As illustrated in FIGS. 1 and 2, image forming apparatus 1 includes image reading section 11, operation display section 12, image processing section 13, image forming section 20, sheet feeding section 14, sheet ejection section 15, sheet conveyance section 30, and control section 18.

Control section 18 includes central processing unit (CPU) 181, read only memory (ROM) 182, random access memory (RAM) 183 and the like. CPU 181 reads a program suited to processing details out of ROM 182 or storage section 192, develops the program in RAM 183, and integrally controls an operation of each block of image forming apparatus 1 in cooperation with the developed program.

Communication section 191 has various interfaces such as network interface card (NIC), modulator-demodulator (MODEM), and universal serial bus (USB), for example.

Storage section 192 is composed of, for example, a non-volatile semiconductor memory (so-called flash memory) or a hard disk drive. Storage section 192 stores therein a look-up table which is referenced when the operation of each block is controlled, for example.

Control section 18 transmits and receives various data to and from an external apparatus (for example, a personal computer) connected to a communication network such as a local area network (LAN) or a wide area network (WAN), through communication section 191. Control section 18 receives image data (input image data) of page description language (PDL) that has been sent from an external device, and controls the apparatus to form an image on a sheet on the basis of the data, for example.

Image reading section 11 includes an automatic document feeder 111 called auto document feeder (ADF), document image scanner (scanner) 112, and the like.

Auto document feeder 111 causes a conveyance mechanism to feed documents placed on a document tray, and sends out the documents to document image scanner 112. Auto document feeder 111 enables images (even both sides thereof) of a large number of documents placed on the document tray to be successively read at once.

Document image scanner 112 optically scans a document fed from auto document feeder 111 to its contact glass or a document placed on its contact glass, and images light reflected from the document on the light receiving surface of charge coupled device (CCD) sensor 112*a*, to thereby read the document image. Image reading section 11 generates input image data on the basis of a reading result provided by document image scanner 112. Image processing section 13 performs predetermined image processing on the input image data.

Operation display section 12 includes, for example, a liquid crystal display (LCD) with a touch panel, and functions as display section 121 and operation section 122. Display section 121 displays various operation screens, image conditions, operating statuses of functions, and the like in accordance with display control signals received from control section 18. Operation section 122 includes various operation keys such as numeric keys and a start key, receives various input operations performed by a user, and outputs operation signals to control section 18.

By operating operation display section 12, the user can perform setting relating to the image formation such as document setting, image quality setting, multiplying factor setting, application setting, output setting, single-sided/duplex printing setting, and sheet setting. In addition, an unjamming procedure is displayed on operation display section 12 when a jam has occurred.

Image processing section 13 includes a circuit that performs a digital image process suited to initial settings or user settings on the input image data, and the like. For example, image processing section 13 performs tone correction on the basis of tone correction data (tone correction table), under the control of control section 18. Image processing section 13 also performs various correction processes such as color correction and shading correction as well as a compression process, on the input image data. Image forming section 20 is controlled on the basis of the image data that has been subjected to these processes.

Image forming section 20 includes: image forming units 21 (toner image forming section) configured to form images of colored toners respectively containing a Y component, an M component, a C component, and a K component on the basis of the input image data; intermediate transfer unit 22 (transfer section) configured to transfer a toner image formed by the image forming units to a sheet; fixing section 23 configured to fix a transferred toner image to a sheet; and the like.

Image forming unit 21 includes image forming units 21Y, 21M, 21C, and 21K for the Y component, the M component, the C component, and the K component, respectively. Since image forming units 21Y, 21M, 21C, and 21K have similar configurations, common elements are denoted by the same reference signs for ease of illustration and description. Only when elements need to be discriminated from one another, Y, M, C, or K is added to their reference signs. In FIG. 1, reference signs are given to only the elements of image forming unit 21Y for the Y component, and reference signs are omitted for the elements of other image forming units 21M, 21C, and 21K.

Image forming unit 21 includes exposing device 211, developing device 212, photoconductor drum 213, charging device 214, drum cleaning device 215 and the like.

Photoconductor drum 213 is, for example, a negative-charge-type organic photoconductor (OPC) formed by sequentially laminating an under coat layer (UCL), a charge generation layer (CGL), and a charge transport layer (CTL) on the circumferential surface of a conductive cylindrical body (aluminum-elementary tube) made of aluminum.

The charge generation layer is made of an organic semiconductor in which a charge generating material (for example, phthalocyanine pigment) is dispersed in a resin binder (for example, polycarbonate), and generates a pair of positive charge and negative charge through light exposure by exposure device 211. The charge transport layer is made of a layer in which a hole transport material (electron-donating nitrogen compound) is dispersed in a resin binder (for example, polycarbonate resin), and transports the positive charge generated in the charge generation layer to the surface of the charge transport layer.

Charging device 214 is composed of a corona discharging generator such as a scorotron charging device and a corotron charging device, for example. Charging device 214 evenly negatively charges the surface of photoconductor drum 213 by corona discharge.

Exposing device 211 is composed of, for example, an LED print head including an LED array having a plurality of linearly laid out light-emitting diodes (LED), an LPH driving section (driver IC) for driving each LED, and an lens array that brings light radiated from the LED array into an image on photoconductor drum 213, and the like. Each of the LEDs of LED array 1 corresponds to one dot of an image. Control section 18 controls the LPH driving section to cause a predetermined driving current to flow through the LED array, and thus designated LEDs emit light.

Exposure device 211 irradiates photoconductor drum 213 with light corresponding to the image of each color component. The positive charge generated in the charge generation layer of photoconductor drum 213 is transported to the surface of the charge transport layer, whereby the surface charge (negative charge) of photoconductor drum 213 is neutralized. Thus, an electrostatic latent image of each color component is formed on the surface of photoconductor drum 213 by the potential difference from its surroundings.

Developing device 212 stores developers of respective color components (for example, two-component developers composed of toner and magnetic carrier). Developing device 212 attaches the toners of respective color components to the surface of photoconductor drum 213, and thus visualizes the electrostatic latent image to form a toner image. To be more specific, a developing bias voltage is applied to a developer bearing member (developing roller), and, by the potential difference between photoconductor drum 213 and the developer bearing member, the charged toner on the developer bearing member is moved and attached to a light-exposed part on the surface of photoconductor drum 213.

Drum cleaning device 215 includes a drum cleaning blade that is brought into sliding contact with the surface of photoconductor drum 213, and removes residual toner that remains on the surface of photoconductor drum 213 after the primary transfer.

Intermediate transfer unit 22 includes intermediate transfer belt 221, primary transfer roller 222, a plurality of support rollers 223, secondary transfer roller 224, belt cleaning device 225, and the like.

Intermediate transfer belt 221 is composed of an endless belt, and is stretched around the plurality of support rollers 223 in a loop form. At least one of the plurality of support rollers 223 is composed of a driving roller, and the others are each composed of a driven roller. Preferably, for example, support roller 223 disposed on the downstream side in the belt travelling direction relative to primary transfer support rollers 222 for K-component is a driving roller. When driving roller rotates, intermediate transfer belt 221 travels in arrow A direction at a constant speed.

Primary transfer rollers 222 are disposed on the inner periphery side of intermediate transfer belt 221 in such a manner as to face photoconductor drums 213 of respective color components. Primary transfer rollers 222 are brought into pressure contact with photoconductor drums 213 with intermediate transfer belt 221 therebetween, whereby a primary transfer nip for transferring a toner image from photoconductor drums 213 to intermediate transfer belt 221 is formed.

Secondary transfer roller 224 is disposed on the outer periphery side of intermediate transfer belt 221 in such a manner as to face one of support rollers 223. Support roller 223 that is so disposed as to face intermediate transfer belt 221 is called "backup roller." Secondary transfer roller 224 is brought into pressure contact with the backup roller with intermediate transfer belt 221 therebetween, whereby a secondary transfer nip for transferring a toner image from intermediate transfer belt 221 to a sheet is formed.

In the primary transfer nip, the toner images on photoconductor drums 213 are sequentially primary-transferred to intermediate transfer belt 221. To be more specific, a primary transfer bias is applied to primary transfer rollers 222, and electric charge of the polarity opposite to the polarity of the toner is applied to the rear side (the side that makes contact with primary transfer rollers 222) of intermediate transfer belt 221, whereby the toner image is electrostatically transferred to intermediate transfer belt 221.

Thereafter, when the sheet passes through the secondary transfer nip, the toner image on intermediate transfer belt 221 is secondary-transferred to the sheet. To be more specific, a secondary transfer bias is applied to secondary transfer roller 224, and an electric charge opposite to that of the toner is applied to the rear side (the side that makes contact with secondary transfer roller 224) of the sheet, whereby the toner image is electrostatically transferred to the sheet. The sheet on which the toner image has been transferred is conveyed toward fixing section 23.

Belt cleaning device 225 includes a belt cleaning blade configured to make sliding contact with the surface of intermediate transfer belt 221, and the like, and removes transfer residual toner remaining on the surface of intermediate transfer belt 221 after the secondary transfer.

Alternatively, in intermediate transfer unit 22, it is also possible to adopt a configuration (so-called belt-type secondary transfer unit) in which a secondary transfer belt is installed in a stretched state in a loop form around a plurality of support rollers including a secondary transfer roller in place of secondary transfer roller 224.

Fixing section 23 includes upper fixing section 231 having a fixing side member disposed on a fixing surface (the surface on which a toner image is formed) side of a sheet, lower fixing section 232 having a back side supporting member disposed on the rear surface (the surface opposite to the fixing surface) side of a sheet, heating source 233 configured to heat the fixing side member, a pressure contact separation section (not illustrated) configured to bring the back side supporting member into pressure contact with the fixing side member, and the like.

For example, when upper fixing section 231 is of a roller heating type, the fixing roller serves as the fixing side member, and when upper fixing section 231 is of a belt heating type, the fixing belt serves as the fixing side member. In addition, for example, when lower fixing section 232 is of a roller pressing type, the pressure roller serves as the back side supporting member, and when lower fixing section 232 is of a belt pressing type, the pressing belt serves as the back side supporting member. The fixing side member and back side supporting member are also collectively called "fixing member."

FIG. 1 illustrates a configuration in which upper fixing section 231 is of a roller heating type, and lower fixing section 232 is of a roller pressing type.

Upper fixing section 231 includes upper fixing section-driving section (not illustrated) for rotating the fixing side member. When control section 18 controls the operation of upper fixing section-driving section, the fixing side member rotates (travels) at a predetermined speed. Lower fixing section 232 includes lower fixing section-driving section (not illustrated) for rotating the back side supporting member. When control section 18 controls the operation of the lower fixing section-driving section, the back side supporting member rotates (travels) at a predetermined speed. It is to be noted that, in the case where the fixing side member follows the rotation of the back side supporting member, the upper fixing section-driving section is not required.

Heating source 233 is disposed inside or near the fixing side member. When control section 18 controls the output of heating source 233, the fixing side member is heated, and the fixing temperature is maintained at a predetermined temperature (for example, a fixable temperature, or a fixation idling temperature). On the basis of the detection result of fixing temperature detection section (not illustrated) disposed at a position near the fixing side member, control section 18 controls the output of heating source 233.

In addition, when control section 18 controls the operation of a pressure contact separation section (not illustrated) such that the back side supporting member is brought into pressure contact with the fixing side member, a fixing nip for conveying a sheet in a tightly sandwiching manner is formed. A toner image is secondary-transferred, and heat and pressure are applied to a sheet which has been conveyed along a sheet feeding path, at the time when the sheet passes through the nip portion. Thus, the toner image is fixed to the sheet.

Fixing section 23 may include an air blowing section that applies air to the fixing side member or the back side supporting member to cool down the fixing side member or the back side supporting member, and to separate a sheet from the fixing side member or the back side supporting member.

Sheet feeding section 14 includes sheet feed tray section 141 and manual sheet feeding section 142. Flat sheets (standard type sheets and special type sheets) discriminated on the basis of their weight, size and the like are stored in sheet feed tray section 141 in advance on a predetermined type basis. A long sheet which cannot be stored in sheet feed tray section 141 is fed from manual sheet feeding section 142.

The "long sheet" is a sheet which may cause scattering of toner at the time when the sheet is pulled out from the sheet feeding side or the sheet ejection side to perform unjamming, that is, a sheet having a length greater than that of the sheet feeding path extending from sheet feeding side boundary B1 described later to secondary transfer nip $N_T$, or that of the sheet feeding path extending from the fixing nip $N_F$ to sheet ejection side boundary B2 (for example, a sheet having a sheet length of 1,000 mm or more). Examples of the "long sheet" include roll paper, continuous paper and the like. In the case of a long sheet having a length greater than that of the sheet feeding path of conveyance path P2, it can be said that the long sheet exists across sheet feeding side boundary B1 or sheet ejection side boundary B2 except for the period immediately after the start of sheet feeding and the period immediately before the completion of sheet ejection.

Sheet ejection section 15 includes sheet ejection roller section 151 and the like, and ejects a sheet output by sheet conveyance section 30 from the apparatus.

Sheet conveyance section 30 includes main sheet feeding path section 31, switchback path section 32, rear surface printing path section 33, sheet feeding path switching section (not illustrated) and the like. Together with fixing section 23, sheet conveyance section 30 is incorporated in a unit, and is detachably mounted in image forming apparatus 1 as sheet conveyance unit ADU.

Main sheet feeding path section 31 includes a plurality of conveyance roller sections including an intermediate conveyance roller section, a loop roller section, and a registration roller section (which are not illustrated). Main sheet feeding path section 31 conveys a sheet (including a long sheet) fed from sheet feeding section 14 through image forming section 20 (a secondary transfer nip, and a fixing nip), and conveys a sheet output from image forming section 20 (fixing section 23) to ejection section 15.

Switchback path section 32 temporarily stops a sheet output from fixing section 23, reverses the sheet in the conveyance direction, and conveys the sheet to sheet ejection section 15 or rear surface printing path section 33.

Rear surface printing path section 33 is a circulation path for conveying a sheet switchbacked and output by switchback path section 32 to main sheet feeding path section 31 (upstream of loop roller section). A sheet whose second surface (rear surface) faces upward passes through main sheet feeding path section 31.

Sheet feeding path switching section (not illustrated) switches the conveyance paths according to whether a sheet output from fixing section 23 is to be ejected as it is, or is to be inverted before being ejected, or, is conveyed to rear surface printing path section 33. To be more specific, control section 18 controls the operation of sheet feeding path-switching section 57 on the basis of the processing detail of the image formation process (one-side/both-side printing, face-up sheet ejection, face-down sheet ejection, and the like).

A sheet fed from sheet feeding section 14 is conveyed to image forming section 20 by main sheet feeding path section 31. Thereafter, a toner image on intermediate transfer belt 221 is secondary-transferred to a first surface (fixing surface) of the sheet at one time at the time when the sheet passes through the transfer nip, and then a fixing process is performed in fixing section 23. A sheet on which an image is formed is ejected out of the apparatus from sheet ejection section 15. In the case where images are to be formed on both sides of a sheet, an image is formed on the first surface of the sheet, and the sheet is conveyed and inverted by sheet switchback path section 32 and rear surface printing path section 33, and then, an image is formed on the second surface of the sheet.

Sheet feeding path P of image forming apparatus 1 is made up of a sheet feeding path of sheet feeding section 14 (hereinafter referred to as "sheet feeding path P1"), a sheet feeding path of sheet conveyance section 30 (hereinafter referred to as "conveyance path P2"), and a sheet feeding path of sheet ejection section 15 (hereinafter referred to as "sheet ejection path P3"). While conveyance path P2 in sheet conveyance unit ADU is detachable from image forming apparatus 1, sheet feeding path P1 and sheet ejection path P3 are fixed in the image forming apparatus main body.

Further, in sheet feeding path P, a plurality of sheet detection sensors which detect the presence or absence of a sheet is disposed. In FIG. 1, sheet detection sensors S1 to S4 are disposed at four positions: a position near the boundary between sheet feeding path P1 and conveyance path P2, a position on the downstream side of the secondary transfer nip in the sheet conveyance direction, a position on the downstream side of the fixing nip in the sheet conveyance direction, and a position near the boundary between conveyance path P2 and sheet ejection path P3. In the following description, the boundary between sheet feeding path P1 and conveyance path P2 is referred to as "sheet feeding side boundary B1," and the boundary between conveyance path P2 and sheet ejection path P3 is referred to as "sheet ejection side boundary B2."

Sheet detection sensors S1 to S4 are, for example, light sensors having light emitting elements and photodetectors. Sheet detection sensors S1 to S4 emit light from the light emitting elements to a sheet, and receive the light reflected from the sheet by the photodetectors to determine the presence/absence of a sheet (the time at which the leading end of a sheet reaches their detection regions and the time at which the rear end of the sheet passes over their detection regions).

In addition, sheet feeding side cutting section 41 is disposed on the upstream side of sheet feeding side boundary B1 in the sheet conveyance direction. Sheet feeding side cutting section 41 is, for example, a cutting section of a slide type or a guillotine type. Control section 18 controls the operation of a cutter driving section (not illustrated), and thus a cutting member (not illustrated) cuts a sheet in the width direction.

Sheet ejection side cutting section 42 is disposed on the downstream side of sheet ejection side boundary B2 in the sheet conveyance direction. The configuration of sheet ejection side cutting section 42 is similar to that of sheet feeding side cutting section 41.

When a jam has occurred, sheet feeding side cutting section 41 and sheet ejection side cutting section 42 automatically cut a sheet as necessary.

On the sheet feeding side of conveyance path P2, a sheet feeding side unjamming nob (not illustrated) for manually sending out a sheet in the conveyance direction is disposed. The sheet feeding side unjamming nob is connected with at least one of the conveyance roller sections on main sheet feeding path section 31 through a power transmission mechanism. When a sheet is cut by sheet feeding side cutting section 41 disposed at a position on the upstream side relative to sheet feeding side boundary B1 in the sheet conveyance direction, a part of the sheet protrudes from conveyance path P2 to sheet feeding path P1. By operating the sheet feeding side unjamming nob, the user manually sends out the sheet in the sheet conveyance direction, and pushes the sheet into sheet conveyance unit ADU. Thus, it is possible to prevent the part protruding to sheet feeding path P1 from hindering the pull-out operation of sheet conveyance unit ADU.

Similarly, on the sheet ejection side of conveyance path P2, a sheet ejection side unjamming nob (not illustrated) for manually sending out a sheet in the conveyance direction is disposed. The sheet ejection side unjamming nob is connected with at least one of the conveyance roller sections on main sheet feeding path section 31 through a power transmission mechanism. When a sheet is cut by sheet ejection side cutting section 42 disposed at a position on the downstream side relative to sheet ejection side boundary B2 in the sheet conveyance direction, a part of the sheet protrudes from conveyance path P2 to sheet ejection path P3. By operating the sheet ejection side unjamming nob, the user manually sends out the sheet in the direction opposite to the sheet conveyance direction, and pushes the sheet into sheet conveyance unit ADU. Thus, it is possible to prevent the part protruding to conveyance path P2 from hindering the pull-out operation of sheet conveyance unit ADU.

It is preferable that the sheet feeding side unjamming nob and the sheet ejection side unjamming nob can be operated only in the direction for pushing a sheet into sheet conveyance unit ADU. In this case, for example, a one-way clutch that transmits a rotational force only in one direction may be adopted as a part of the power transmission mechanism. In this manner, it is possible to prevent a sheet from being sent out to the sheet feeding path P1 side or the sheet ejection path side P3 by user's wrong operation.

When a jam has occurred in conveyance path P2 of image forming apparatus 1, unjamming can be performed by pulling out sheet conveyance unit ADU. However, when a long sheet having a length greater than that of conveyance path P2 is used for image formation, the long sheet exists across sheet feeding side boundary B1 or sheet ejection side boundary B2 except for the period immediately after the start of sheet feeding and the period immediately before the end of sheet ejection. If sheet conveyance unit ADU is pulled out in this state, breaking occurs. In the present embodiment, a long sheet is cut as necessary at a position near sheet feeding side boundary B1 or sheet ejection side boundary B2, and a suitable unjamming procedure is indicated, whereby breaking is prevented from occurring, and the unjamming work is facilitated.

Specifically, in the present embodiment, control section 18 functions as a jam clearing section that determines the unjamming procedure in accordance with the state of the sheet on sheet feeding path P when a jam has occurred, and makes a request to perform unjamming according to the determined procedure. To be more specific, control section 18 executes a jam clearing process according to the flowchart illustrated in FIG. 3.

Figure 3:
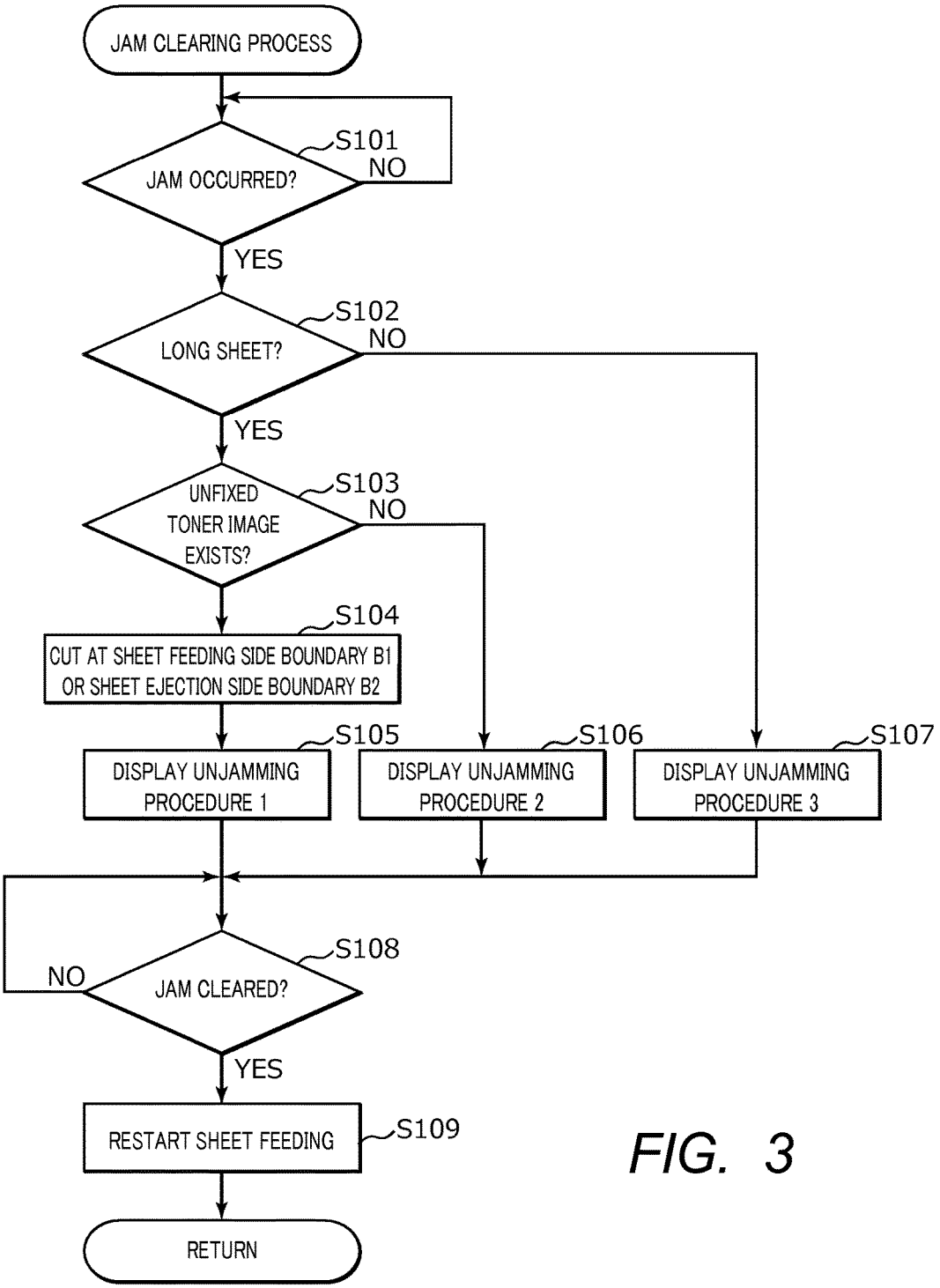
FIG. 3 is a flowchart illustrating an exemplary jam clearing process.

FIG. 3 is a flowchart illustrating an exemplary jam clearing process. This process is achieved when CPU 181 executes a predetermined program stored in ROM 182 upon the start of an image formation process in image forming apparatus 1 for example.

At step S101 of FIG. 3, control section 18 determines whether a jam has occurred. For example, since the conveyance roller sections disposed in sheet feeding path P stop when an abnormal torque is generated, control section 18 detects occurrence of a jam on the basis of the stoppage. When a jam has occurred (at step S101 "YES"), the process is advanced to step S102. When no jam has occurred (at step S101 "NO"), the process of step S101 is repeated, and the jam clearing process is terminated when a series of image formation processes are terminated.

At step S102, control section 18 determines whether a long sheet is used for the image formation. When a long sheet is used for the image formation (at step S102 "YES"), the process is advanced to step S103. When a long sheet is not used for the image formation (at step S102 "NO"), or in other words, when flat sheets are used for image formation, the process is advanced to step S107.

At step S103, control section 18 determines whether a toner image in an unfixed state (unfixed toner image) is borne on a long sheet. To be more specific, control section 18 determines the state of a sheet when a jam has occurred on the basis of detection results of sheet detection sensors S1 to S4.

Figure 4A:
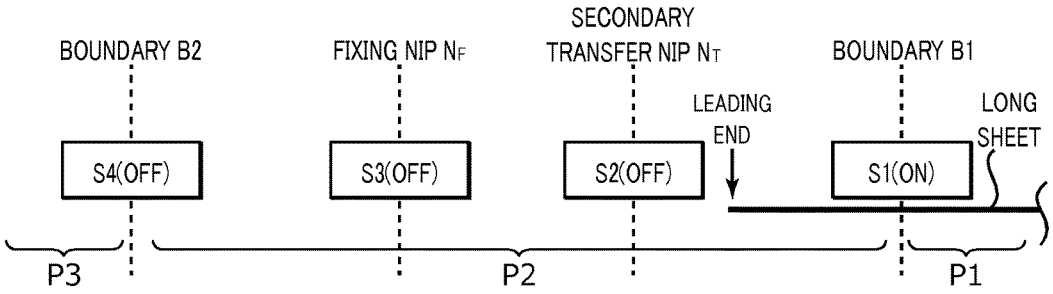
FIG. 4A illustrates a state of a sheet on a sheet feeding path when a jam has occurred (a state where the leading end of the sheet is located between a sheet feeding side boundary and a secondary transfer nip)

As illustrated in FIG. 4A, when a sheet is detected by sheet detection sensor S1 (sensor output: ON), and no sheet is detected by sheet detection sensors S2 to S4 (sensor output: OFF), it is determined that the jam has occurred in the state where the leading end of the sheet is located between sheet feeding side boundary B1 and secondary transfer nip $N_T$.

Figure 4B:
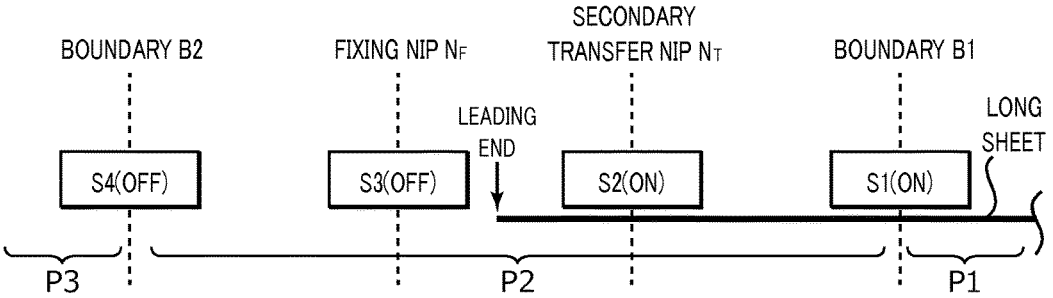
FIG. 4B illustrates a state of a sheet on the sheet feeding path when a jam has occurred (a state where the leading end of the sheet is located between the secondary transfer nip and a fixing nip)

As illustrated in FIG. 4B, when a sheet is detected by sheet detection sensors S1 and S2, and no sheet is detected by sheet detection sensors S3 and S4, it is determined that the jam has occurred in the state where the leading end of the sheet is located between secondary transfer nip $N_T$ and fixing nip $N_F$.

Figure 4C:
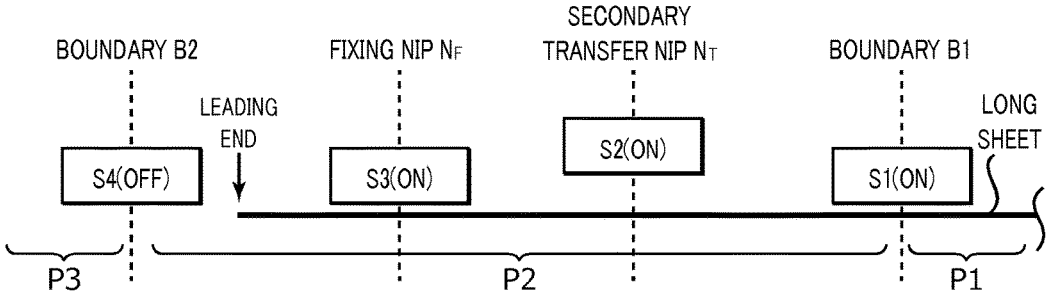
FIG. 4C illustrates a state of a sheet on the sheet feeding path when a jam has occurred (a state where a leading end of the sheet is located between the fixing nip and a sheet ejection side boundary)

As illustrated in FIG. 4C, when a sheet is detected by sheet detection sensors S1 to S3, and no sheet is detected by sheet detection sensor S4, it is determined that the jam has occurred in the state where the leading end of the sheet is located between fixing nip $N_F$ and sheet ejection side boundary B2.

Figure 4D:
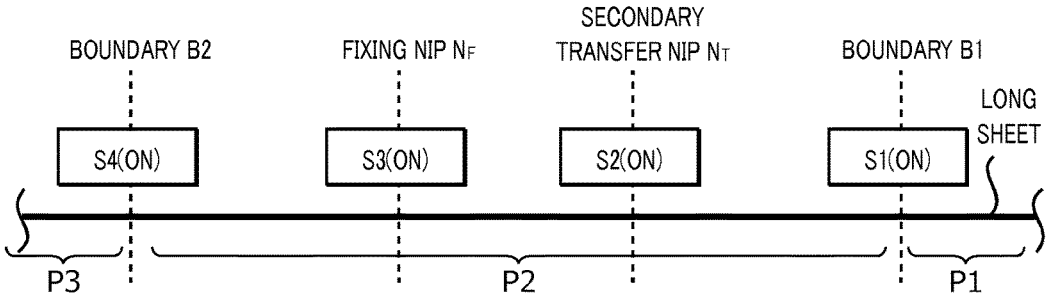
FIG. 4D illustrates a state of a sheet on the sheet feeding path when a jam has occurred (a state where the sheet exists over the entire length)

As illustrated in FIG. 4D, when a sheet is detected by sheet detection sensors S1 to S4, it is determined that the jam has occurred in the state where the sheet exists over the entire length of the sheet feeding path P.

Figure 5A:
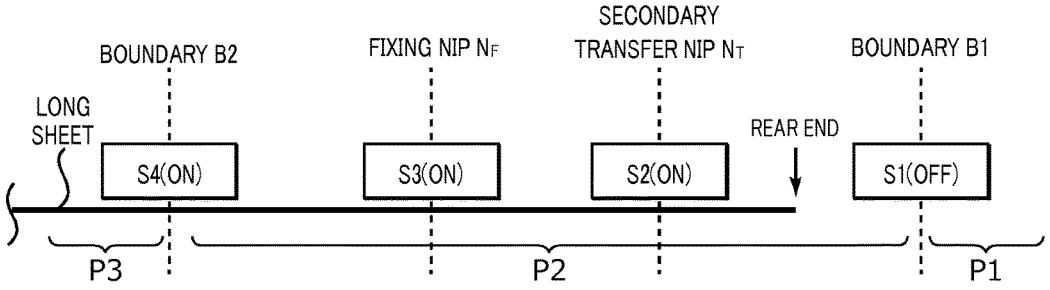
FIG. 5A illustrates a state of a sheet on the sheet feeding path when a jam has occurred (a state where the rear end of the sheet is located between the sheet feeding side boundary and a secondary transfer nip)

As illustrated in FIG. 5A, when no sheet is detected by sheet detection sensor S1, and a sheet is detected by sheet detection sensors S2 to S4, it is determined that the jam has occurred in the state where the rear end of the sheet is located between sheet feeding side boundary B1 and secondary transfer nip $N_T$.

Figure 5B:
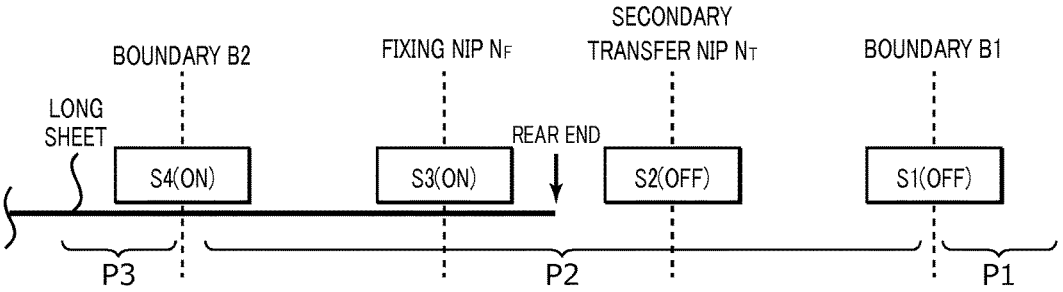
FIG. 5B illustrates a state of a sheet on the sheet feeding path when a jam has occurred (a state where the rear end of the sheet is located between the secondary transfer nip and the fixing nip)

As illustrated in FIG. 5B, when no sheet is detected by sheet detection sensors S1 and S2, and a sheet is detected by the sheet detection sensors S3 and S4, it is determined that the jam has occurred in the state where the rear end of the sheet is located between secondary transfer nip $N_T$ and fixing nip $N_F$.

Figure 5C:
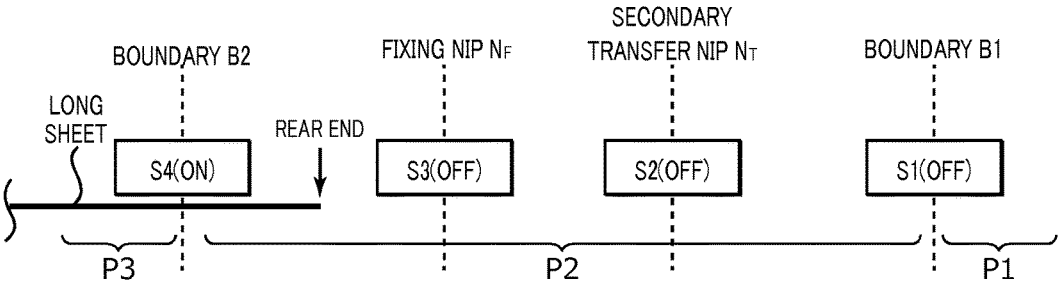
FIG. 5C illustrates a state of a sheet on the sheet feeding path when a jam has occurred (a state where the rear end of the sheet is located between the fixing nip and the sheet ejection side boundary)

As illustrated in FIG. 5C, when no sheet is detected by sheet detection sensors S1 to S3, and a sheet is detected by sheet detection sensor S4, it is determined that the jam has occurred in the state where the rear end of the sheet is located between fixing nip $N_F$ and sheet ejection side boundary B2.

Thus, when the long sheet is in any of the states illustrated in FIG. 4B to FIG. 4D, FIG. 5A and FIG. 5B, control section 18 determines that an unfixed toner image is borne on the long sheet. On the other hand, when the long sheet is in the state illustrated in FIG. 4A or FIG. 5C, a toner image is not yet transferred or a toner image has been fixed, and therefore control section 18 determines that an unfixed toner image is not borne on the long sheet. When an unfixed toner image is borne on the long sheet (at step S103 "YES"), the process is advanced to step S104. When no unfixed toner image is borne on the long sheet (at step S103 "NO"), the process is advanced to step S106.

At step S104, control section 18 controls the operation of sheet feeding side cutting section 41 or sheet ejection side cutting section 42 to cut the sheet at a position near the boundary (sheet feeding side boundary B1 or sheet ejection side boundary B2) across which the long sheet exists.

At step S105, control section 18 controls operation display section 12 to display unjamming procedure 1. Unjamming procedure 1 is a procedure for the case where an unfixed toner image is borne on a long sheet.

To be more specific, when the long sheet is in the state illustrated in FIG. 4B or FIG. 4C, sheet feeding side cutting section 41 cuts the long sheet at a position near sheet feeding side boundary B1. Operation display section 12 displays the message illustrated in FIG. 6A (unjamming procedure 1-1). According to the displayed message, the user pulls out the long sheet remaining in sheet feeding section 14, as procedure 1. As procedure 2, the user turns the sheet feeding side unjamming nob two turns, to push into sheet conveyance unit ADU the part protruding from sheet conveyance unit ADU to sheet feeding section 14. Thereafter, as procedure 3, the user pulls out sheet conveyance unit ADU so as to expose the guide member and the like, and carefully removes the long sheet from a proper place.

When the long sheet is in the state illustrated in FIG. 4D, sheet feeding side cutting section 41 cuts the long sheet at a position near sheet feeding side boundary B1, and sheet ejection side cutting section 42 cuts the long sheet at a position near sheet ejection side boundary B2. The message illustrated in FIG. 6B is displayed on operation display section 12 (unjamming procedure 1-2). According to the displayed message, the user pulls out the long sheet remaining in sheet feeding section 14, as procedure 1. As procedure 2, the user turns the sheet feeding side unjamming nob two turns, to push into sheet conveyance unit ADU the part protruding from sheet conveyance unit ADU to sheet feeding section 14. In addition, as procedure 3, the user turns the unjamming nob two turns to push into sheet conveyance unit ADU the part protruding from sheet conveyance unit ADU to sheet ejection section 15. Thereafter, as procedure 4, the user pulls out sheet conveyance unit ADU so as to expose the guide member and the like, and carefully removes the long sheet from a proper place.

When the long sheet is in the state illustrated in FIG. 5A or FIG. 5B, the sheet ejection side cutting section 42 cuts the long sheet at a position near sheet ejection side boundary B2. The message illustrated in FIG. 6C is displayed on operation display section 12 (unjamming procedure 1-3). According to the displayed message, the user pulls out the long sheet remaining in sheet ejection section 15 as procedure 1. As procedure 2, the user turns the sheet ejection side unjamming nob two turns to push into sheet conveyance unit ADU the part protruding from sheet conveyance unit ADU to sheet ejection section 15. Thereafter, as procedure 3, the user pulls out sheet conveyance unit ADU so as to expose the guide member and the like, and carefully removes the long sheet from a proper place.

As described, when an unfixed toner image is borne on a sheet and the sheet exists across a boundary (sheet feeding side boundary B1 or sheet ejection side boundary B2) in the case where a jam has occurred, control section 18 serving as the jam clearing section requests to cut the sheet at a position near a boundary as a cutting position, and to pull out the first sheet feeding path (conveyance path P2) to perform unjamming.

In addition, control section 18 serving as the jam clearing section requests to cut the sheet, and to pull out the first sheet feeding path to perform unjamming, after the part of the sheet extending from the first sheet feeding path to the second sheet feeding path is pushed into first sheet feeding path with use of a pushing operation section (the sheet feeding side unjamming nob or the sheet ejection side unjamming nob).

Thus the user can easily pull out the sheet conveyance unit ADU without causing breaking, and the unjamming work is remarkably facilitated.

At step S106 of FIG. 3, control section 18 controls operation display section 12 to display unjamming procedure 2. Unjamming procedure 2 is a procedure for the case where no unfixed toner image is borne on a long sheet.

To be more specific, when a long sheet is in the state illustrated in FIG. 4A, the message illustrated in FIG. 7A is displayed on operation display section 12 (unjamming procedure 2-1). According to the displayed message, the user pulls out the long sheet remaining in sheet feeding section 14 including the part advanced in sheet conveyance unit ADU, from the sheet feeding side.

In addition, when the long sheet is in the state illustrated in FIG. 5C, the message illustrated in FIG. 7B is displayed on operation display section 12 (unjamming procedure 2-2). According to the displayed message, the user pulls out the long sheet remaining in sheet ejection section 15 including the part remaining in sheet conveyance unit ADU, from the sheet ejection side.

Since no unfixed toner image is borne on the long sheet, unfixed toner does not scatter at the time when the long sheet is pulled out. Since it is only necessary for the user to pull out the long sheet from the sheet feeding side or the sheet ejection side without pulling out sheet conveyance unit ADU, the user can easily perform unjamming.

At step S107 of FIG. 3, control section 18 controls operation display section 12 to display unjamming procedure 3. Unjamming procedure 3 is a procedure for the case where image formation using flat sheets is performed. A publicly known procedure can be applied as unjamming procedure 3, and therefore the description thereof is omitted.

At step S108, control section 18 determines whether the jam has been cleared. For example, when operation display section 12 is operated to restart image formation, control section 18 determines that the jam has been cleared. When an abnormal torque is generated during the operation of the conveyance roller, it is determined that the jam has not been cleared, and therefore the process of step S108 is repeated.

At step S109, control section 18 restarts feeding of a sheet. Image formation on a sheet is restarted, and also the jam clearing process is again executed from step S101.

As described, image forming apparatus 1 includes image forming section (20) configured to form an image on a sheet; and sheet feeding path (P) including a first sheet feeding path (conveyance path P2 in sheet conveyance unit ADU) configured to convey a sheet to the image forming section and a second sheet feeding path (sheet feeding path P1 and sheet ejection path P3) provided continuously with the first sheet feeding path. Unjamming is allowed to be performed by separating image forming apparatus 1 at a boundary between the first sheet feeding path and the second sheet feeding path (sheet feeding side boundary B1 and sheet ejection side boundary B2), and by pulling out the first sheet feeding path.

Image forming apparatus 1 further includes: a jam detection section (the conveyance roller section of sheet conveyance section 30 and control section 18) configured to detect an occurrence of a jam in the sheet feeding path; and a jam clearing section (control section 18) configured to determine a procedure for unjamming in accordance with a state of a sheet on the sheet feeding path when a jam occurs, and to make a request to perform unjamming according to a determined procedure.

To be more specific, image forming apparatus 1 includes an information indication section (operation display section 12) configured to present information to a user, and the jam clearing section (control section 18) controls the information indication section to indicate a determined unjamming procedure.

In image forming apparatus 1, when a jam has occurred, a suitable unjamming procedure is determined in accordance with the state of a sheet on the sheet feeding path, and a request is made to perform unjamming according to the determined procedure, and thus an unjamming work for the long sheet is remarkably facilitated.

While the invention made by the present inventor has been specifically described based on the preferred embodiments, it is not intended to limit the present invention to the above-mentioned preferred embodiments but the present invention may be further modified within the scope and spirit of the invention defined by the appended claims.

For example, a configuration is also possible in which sheet feeding side cutting section 41 and sheet ejection side cutting section 42 are omitted and the user cuts the sheet at the places thereof. In this case, as unjamming procedure 1, a cutting place is indicated, and the user is requested to cut the sheet at the place. In addition, a space for manually cutting the sheet is required.

For example, when the long sheet is the state illustrated in FIG. 4B or FIG. 4C, unjamming procedure 1-1 illustrated in FIG. 8A is displayed instead of unjamming procedure 1-1 illustrated in FIG. 6A. When the long sheet is in the state illustrated in FIG. 4D, unjamming procedure 1-2 illustrated in FIG. 8B is displayed instead of unjamming procedure 1-2 illustrated in FIG. 6B. When the long sheet state is in the state illustrated in FIG. 5A or FIG. 5B, unjamming procedure 1-3 illustrated in FIG. 8C is displayed instead of unjamming procedure 1-3 illustrated in FIG. 6C. In the above-mentioned cases, the cutting place may be indicated so that the user can easily determine the cutting place.

In addition, the sheet cutting position on the sheet feeding side may be located on the downstream side of sheet feeding side boundary B1 in the sheet conveyance direction (in sheet conveyance unit ADU), and the sheet cutting position on the sheet ejection side may be located on the upstream side of sheet ejection side boundary B2 in the sheet conveyance direction (in sheet conveyance unit ADU). In this case, since a sheet extends from sheet feeding path P1 to conveyance path P2, or extends from sheet ejection path P3 to conveyance path P2 after the sheet is cut, a configuration is adopted in which such a part is removed by operating the sheet feeding side unjamming nob or the sheet ejection side unjamming nob serving as the pulling operation section. It is preferable that the sheet feeding side unjamming nob and the sheet ejection side unjamming nob can be operated only in the direction for pulling out a sheet from sheet conveyance unit ADU. For this purpose, a one-way clutch that transmits a rotational force only in one direction may be adopted as a part of the power transmission mechanism, for example. In this manner, it is possible to prevent a sheet from being sent into sheet conveyance unit ADU by user's wrong operation.

The embodiment disclosed herein is merely an exemplification and should not be considered as limitative. The scope of the present invention is specified by the following claims, not by the above-mentioned description.

It should be understood that various modifications, combinations, sub-combinations and alterations may occur depending on design requirements and other factors in so far as they are within the scope of the appended claims or the equivalents thereof.

What is claimed is:

1. An image forming apparatus comprising:

an image forming section configured to form an image on a long sheet of 1000 mm or more;

a sheet feeding path including a first sheet feeding path configured to convey a long sheet to the image forming section, and a second sheet feeding path provided continuously with the first sheet feeding path;

a jam detection section configured to detect an occurrence of a jam in the sheet feeding path; and a jam clearing section configured to determine whether a unfixed toner image is borne on a long sheet on the sheet feeding path when a jam occurs and whether the long sheet exists across a boundary, to determine a procedure for unjamming in accordance with a determination result, and to make a request to perform unjamming according to a determined procedure, wherein the jam clearing section is configured such that, in a case where an unfixed toner image is borne on a long sheet and the long sheet exists across the boundary when a jam occurs, the jam clearing section makes a request to pull out the first sheet feeding path to perform unjamming after cutting the sheet at a position near the boundary as a cutting position;

the image forming apparatus is an electrophotographic image forming apparatus in which unjamming is allowed to be performed by separating the image forming apparatus at the boundary between the first sheet feeding path and the second sheet feeding path, and by pulling out the first sheet feeding path.

2. The image forming apparatus according to claim 1 further comprising an information indication section configured to present information to a user, wherein the jam clearing section controls the information indication section to indicate the determined procedure for unjamming.

3. The image forming apparatus according to claim 1 further comprising a sheet cutting section disposed at the cutting position, wherein the jam clearing section controls the sheet cutting section to cut a long sheet.

4. The image forming apparatus according to claim 1, wherein the cutting position is set on the second sheet feeding path, and, after a long sheet is cut and a part of the long sheet extending from the first sheet feeding path to the second sheet feeding path is pushed into the first sheet feeding path by a pushing operation section, the jam clearing section makes a request to pull out the first sheet feeding path to perform unj amming.

5. The image forming apparatus according to claim 4, wherein the pushing operation section is allowed to operate only in a direction for pushing a long sheet into the first sheet feeding path.

6. The image forming apparatus according to claim 1, wherein the cutting position is set on the first sheet feeding path, and, after a long sheet is cut and a part of the long sheet extending from the second sheet feeding path to the first sheet feeding path is pulled out from the first sheet feeding path by a pulling operation section, the jam clearing section makes a request to pull out the first sheet feeding path to perform unjamming.

7. The image forming apparatus according to claim 6, wherein the pulling operation section is allowed to operate only in a direction for pulling out a long sheet from the first sheet feeding path.

8. The image forming apparatus according to claim 1, wherein a sheet used for image formation has a length greater than a length of a long sheet feeding path extending from the boundary on a sheet feeding side to a transfer nip of the image forming section, or than a length of a sheet feeding path extending from a fixing nip of the image forming section to the boundary on a sheet ejection side.

9. The image forming apparatus according to claim 1, wherein the second sheet feeding path includes a sheet feeding path of a sheet feeding section or a sheet ejection path of a sheet ejection section.

* * * * *